United States Patent [19]

Ernst

[11] Patent Number: 4,478,275

[45] Date of Patent: Oct. 23, 1984

[54] ABRASION RESISTANT HEAT PIPE

[75] Inventor: Donald M. Ernst, Leola, Pa.

[73] Assignee: Thermacore, Inc., Lancaster, Pa.

[21] Appl. No.: 516,631

[22] Filed: Jul. 25, 1983

[51] Int. Cl.[3] ..... F28D 15/00; F28F 19/06

[52] U.S. Cl. ..... 165/133; 29/157.3 H; 165/47; 165/180; 165/104.27

[58] Field of Search ..... 165/133, 180, 47, 104.27; 29/157.3 R, 157.3 H

[56] References Cited

U.S. PATENT DOCUMENTS 4,082,575 4/1978 Eastman .
4,380,154 4/1983 Eastman .

FOREIGN PATENT DOCUMENTS 56-119497 9/1981 Japan ..... 165/133

*Primary Examiner*—Albert W. Davis, Jr.
*Attorney, Agent, or Firm*—Martin Fruitman

[57] ABSTRACT

A specially constructed heat pipe for use in fluidized bed combustors. Two distinct coatings are spray coated onto a heat pipe casing constructed of low thermal expansion metal, each coating serving a different purpose. The first coating forms aluminum oxide to prevent hydrogen permeation into the heat pipe casing, and the second coating contains stabilized zirconium oxide to provide abrasion resistance while not substantially affecting the heat transfer characteristics of the system.

15 Claims, No Drawings

ABRASION RESISTANT HEAT PIPE

BACKGROUND OF THE INVENTION

The United States Government has rights to this invention pursuant to Contract No. 31-109-ENG-38 between the U.S. Department of Energy and The University of Chicago.

This invention deals generally with heat pipes and more specifically with heat pipes to be used in corrosive and abrasive environments such as in fluidized bed combustors driving gas turbine or Stirling engines.

Heat pipes, while used in many other heat transfer applications, have not been widely used in applications where the heat sources are solid fuel fired fluidized beds because of the rapid deterioration of the heat pipe casing when subjected to the environment of such fluidized beds. A coal burning fluidized bed is an attractive solution for reducing the atmospheric emissions when sulfur bearing coal is burned. If such coal is burned in a fluidized bed with limestone or dolomite the sulfur reacts chemically with the limestone to form solid compounds which are readily removed with the solid residue of combustion.

The heat from such fluidized beds combustors can be utilized not only in gas turbine engines, as described by Eastman in U.S. Pat. No. 4,380,154, but can also be the basic power source for Stirling engines or any industrial process using heat within the system's temperature range. Moreover, fluidized beds using other fuels can produce temperatures in other ranges for appropriate applications.

U.S. Pat. No. 4,380,154 by Eastman describes a two-layer system to protect heat pipes within the environment of a fluidized bed from abrasion and deterioration. This dual layer is, however, difficult to attain because the first layer is dependent on using specific material for the heat pipe casing and the first layer itself requires an oven treament lasting between one and ten hours.

A more versatile, more easily attained system for protection of heat pipes from the excessive heat, corrosion, and abrasion of a fluidized bed is needed to permit heat pipe utilization, not only in coal fire fluidized beds, but also in systems using other fuels.

SUMMARY OF THE INVENTION

The present invention attains this goal by furnishing heat pipes coated with two distinct coatings with different qualities for each coating. Unlike the prior method, the present invention can be accomplished by plasma spraying on both layers, and therefore is adaptable to a high production manufacturing process and can be used on heat pipes regardless of their dimensions and with a wider range of casing materials.

The heat pipes of this invention are constructed internally by conventional methods well known in the art, but the casing and the portion of the heat pipes exposed to an abrasive and corrosive environment are specially constructed to meet the requirements of the special conditions.

The casing is constructed of an alloy with thermal expansion matched to the top layer to prevent the possibility of cracking the attached layers during the heating and cooling cycles to which the heat pipe will be subjected during use.

The base material of which the casing is constructed must also contain at least one-tenth percent of aluminum and at least one-tenth percent of either silicon, titanium, yttrium or yttrium oxide or some mixture of these materials. These minor constituents aid in the bond between the base metal and the first layer sprayed onto the casing.

The first of the two layers is a mixture of iron, chromium, aluminum, and yttrium or titanium. The major constituent is iron and the other materials are used in the following ranges of percentages of weights of the total mixture: chromium, 20 to 30%; aluminum 2 to 10%; and yttrium or titanium 0.1 to 2%.

This mixture is sprayed upon the surface of the coating in an even coat of approximately 0.020 inch thickness by conventional plasma spray techniques. The surface of the aluminum forms into aluminum oxide after spraying and bonding to the casing surface, and acts as a hydrogen permeation barrier. This function is vital in any flame containing environment, because without it, hydrogen from outside the casing migrates through the metal casing and, being a non-condensible gas at the temperatures of operation, eventually fills the heat pipe to a point where it blocks proper operation.

The chromium forms into chromium oxide which is highly stable and adds significantly to the protection of the casing material because it will not decompose in the high temperature environment of a combustion chamber.

The yttrium or titanium are included in the mixture because they bond to their counterpart materials in the casing and in the rest of the coating to hold the coating together and onto the casing.

The first coating has the unique and necessary characteristic of being somewhat flexible. This property permits it to absorb some of the strain caused by the difference in thermal expansion between the base metal and the second coating.

The second coating is a hard ceramic coating which is abrasion resistant and does not erode in an environment such as that which exists in a fluidized bed. It is also approximately 0.020 inch thick and consists essentially of commercially available stabilized oxides selected from the group consisting of aluminum, zirconium and yttrium. This choice of material and thickness furnishes the adherance and abrasion resistance needed to survive in the abrasive atmosphere; but, more important, the good heat conductivity across its thickness is such that it does not adversely affect the heat transfer of the total heat pipe system.

Together with the first coating of hydrogen impermeable material this abrasion resisting layer produces a heat pipe which will survive indefinitely in an environment in which it was previously difficult to attain any significant useful life from a heat pipe.

DETAILED DESCRIPTION OF THE PREFERRED EMBODIMENT

The present invention is directed to a heat pipe which resists deterioration in a highly abrasive and hydrogen filled environment. Typically, it is such an environment that exists in a fluidized bed coal combustor where the particles of coal and other materials subject the heat pipe to abrasion, and the hydrogen is present as a result of the combustion process.

The hostile environment causes mechanically destructive abrasion to heat pipes places within it and is also likely to result in hydrogen permeation through the heat pipe casing. The entry of hydrogen into a sealed heat pipe ultimately prevents proper operation of the evaporation - condensation cycle within the heat pipe. Yet heat pipes are very desirable devices for use in transferring heat from fluidized bed combustors to various power generating system such as Stirling engines and closed cycle gas turbines. The present invention therefore separates the two problems of abrasion and hydrogen permeation and solves each one with a separate and distinct coating applied to the exterior of the heat pipe.

In the preferred embodiment, these coatings are applied in sequence to a casing of nickel-chromium steel, Incoloy 800, whose low thermal expansion approximates the thermal expansion rate of the subsequent coatings, preventing stress cracking of the subsequent coatings because it minimizes the differences in thermal expansion between the casing and the two layers. Generally, this thermal expansion matching should be observed within limits which are best established by multiple cycle testing of sample combinations of base material with the coatings applied.

Incoloy 800 is specified as containing the following constituents: nickel, 30–35%; chromium, 19–23%; carbon, 0.1% max.; manganese, 1.5% max.; aluminum, 0.15–0.6%; titanium 0.15–0.6%; and silicon 1.0% max. The balance of the material is iron. It is the last three minor constituents, aluminum, titanium and silicon, which are important to the later coating operations because of their bond with the coatings.

The coatings are applied to the base metal after the casing is formed into its final configuration. While this is typically a simple cylinder, heat pipes may be, and in fact have been, constructed in a great variety of other configurations.

The coatings are applied to the casing by the well established process known as plasma spraying in which a powder is heated in a gun-type applicator and sprayed onto the base material in molten form.

The first coating is applied with a thickness of between 0.005 and 0.050 inches. These limits are necessary because the coating must be thick enough to assure continuity but not so thick as to be susceptible to cracking due to thermal stresses due to differential temperatures.

The first coating is a mixture containing the following materials by percentages of weight: chromium 20 to 30%; aluminum 2 to 10%; yttrium or titanium, 0.1 to 2.0%; and the balance, iron.

This mixture is prepared in powder form with particle sizes of less than 0.0015 inch, and it is plasma sprayed on to the casing. In the preferred embodiment, the hydrogen impermeable layer sprayed on is 0.020 inches thick. Before spraying, however, the base material is cleaned and sandblasted.

During the spraying operation the materials in the spray mixture bond to the base metal forming a new, virgin surface for the subsequent layer. After bonding, the aluminum forms aluminum oxide on its outer surface, which is the major component that acts as a barrier to hydrogen permeation. Chromium oxide which is also formed, aids by blocking base layer and coating oxidation and structurally strengthens and chemically stabilizes the coating, since it is highly stable and not subject to decomposition in the high temperature environment in which the heat pipe will be used. The yttrium or titanium in the coating bonds to the chemically active materials such as aluminum, silicon, titanium and yttrium in the base metal and holds the coating onto the casing.

The second coating is plasma sprayed onto the heat pipe immediately after the first layer, thereby assuring it is placed on a clean and undamaged base. This second layer is also between 0.005 and 0.050 inch thick to assure sufficient protection of the layer below without susceptibility to cracking. In the preferred embodiment 0.020 inch of stabilized zirconium oxide was used. The zirconium oxide typically is stabilized by the use of either magnesium oxide or yttrium oxide, both variants being commercially available.

This second coating of ceramic bonds readily to the first coating and survives repeated heated and cooling cycles because of the somewhat flexible nature of the first layer. The flexibility absorbs enough of the thermal expansion stress to assure survival of this configuration whereas other materials in similar thicknesses crack after multiple thermal cycles.

It is to be understood that the form of this invention as described is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, other base materials could be used as long as the minor constituents of aluminum and either silicon, titanium or yttrium are present. Moreover, titanium and yttrium are generally interchangeable in the first coating.

Moreover, other chromium, aluminum and yttrium mixtures, such as those containing cobalt and nickel can also be used for the first coating, although nickel is more susceptible to attack by sulfur and cobalt is less flexible.

What is claimed as new and desired to be secured by Letters Patent of the United States is:

1. An abrasion and permeation resistant heat pipe comprising:

a casing constructed from material selected to approximate the thermal expansion rate of materials to be coated upon it;

a first layer coated directly onto the casing exterior surface comprising a mixture including aluminum and chromium; and a second layer coated onto the first layer comprising a stabilized oxide selected from the group comprising aluminum, zirconium and yttrium.

2. The heat pipe of claim 1 wherein the first layer also includes between 0.1% and 2.0% of titanium.

3. The heat pipe of claim 1 wherein the first layer also includes between 0.1% and 2.0% of yttrium oxide.

4. The heat pipe of claim 1 wherein the first layer also includes between 0.1% and 2.0% of yttrium.

5. The heat pipe of claim 1 wherein the first layer has a thickness of between 0.005 and 0.050 inches.

6. The heat pipe of claim 1 wherein the second layer has a thickness of between 0.005 and 0.050 inches.

7. The heat pipe of claim 1 wherein the casing material contains between 0.15% and 0.6% aluminum.

8. The heat pipe of claim 1 wherein the casing material contains between 19% and 23% chromium.

9. The heat pipe of claim 1 wherein the casing material contains betwen 0.15% and 0.6% titanium.

10. The heat pipe of claim 1 wherein the first layer is applied to the casing by plasma spraying onto it a mixture of iron, chromium, aluminum and titanium.

11. The heat pipe of claim 1 wherein the first layer is applied to the casing by plasma spraying onto it a mixture containing by weight between 20% and 30% of chromium, between 2% and 10% of aluminum and between 0.1% and 2.0% of titanium, with the balance of the mixture being iron.

12. The heat pipe of claim 1 wherein the first layer is applied to the casing by plasma spraying onto it a mixture of iron, chromium, aluminum and yttrium.

13. The heat pipe of claim 1 wherein the first layer is applied to the casing by plasma spraying onto it a mixture containing by weight between 20% and 30% of chromium, between 2% and 10% of aluminum, and between 0.1% and 2.0% of yttrium, with the balance of the mixture being iron.

14. The heat pipe of claim 1 wherein the first layer is applied to the casing by plasma spraying onto it a mixture containing by weight between 20% and 30% of chromium, between 2% and 10% of aluminum, and between 0.1% and 2.0% of yttrium, with the balance of the mixture being chromium.

15. The heat pipe of claim 1 wherein the first layer is applied to the casing by plasma spraying onto it a mixture containing by weight between 20% and 30% of chromium, between 2% and 10% of aluminum, and between 0.1% and 2.0% of yttrium, with the balance of the mixture being nickel.

* * * * *